US012714135B2

(12) United States Patent
Meloncelli et al.

(10) Patent No.: US 12,714,135 B2
(45) Date of Patent: Aug. 25, 2026

(54) GATHERING ASSEMBLY

(71) Applicant: Philip Morris Products S.A., Neuchatel (CH)

(72) Inventors: Niki Meloncelli, Castel Maggiore (IT); Stefano Zappoli, Bologna (IT); Gastone Minelli, Bologna (IT); Pierfrancesco Ulivi, Strongoli (IT)

(73) Assignee: Philip Morris Products S.A., Neuchatel (CH)

( * ) Notice: Subject to any disclaimer, the term of this patent is extended or adjusted under 35 U.S.C. 154(b) by 420 days.

(21) Appl. No.: 18/576,837

(22) PCT Filed: Jun. 13, 2022

(86) PCT No.: PCT/EP2022/066048
§ 371 (c)(1),
(2) Date: Jan. 5, 2024

(87) PCT Pub. No.: WO2023/280525
PCT Pub. Date: Jan. 12, 2023

(65) Prior Publication Data

US 2024/0306700 A1 Sep. 19, 2024

(30) Foreign Application Priority Data

Jul. 9, 2021 (EP) ..... 21184922

(51) Int. Cl.
*A24C 5/18* (2006.01)
*A24C 5/01* (2020.01)

(52) U.S. Cl.
CPC ..... *A24C 5/01* (2020.01); *A24C 5/1807* (2013.01)

(58) Field of Classification Search
CPC ..... A24C 5/01; A24C 5/1807; A24D 3/0233
See application file for complete search history.

(56) References Cited

U.S. PATENT DOCUMENTS 4,535,789 A 8/1985 Irving et al.
5,370,137 A 12/1994 Kushihashi et al.
(Continued)

FOREIGN PATENT DOCUMENTS

CN 103027373 A 4/2013
CN 107567286 A 1/2018
(Continued)

OTHER PUBLICATIONS

Combined Russian Office Action and Search Report issued Oct. 21, 2025 in Russian Patent Application No. 2024103132/03(006674) (with English Machine Translation), 13 pages.
(Continued)

*Primary Examiner* — Robert C Dye
(74) *Attorney, Agent, or Firm* — Oblon, McClelland, Maier & Neustadt, L.L.P.

(57) ABSTRACT

A gathering assembly for production of an aerosol generating article is provided, the assembly including a gathering element and a support assembly, the element to receive and to gather a material on the support assembly, the element including an inlet to receive the material, an outlet for outward passage of the material, and a converging portion to receive the material from the inlet and to gather the material on the support assembly as the material passes between the inlet and the outlet, the support assembly including a first portion having a fixed position relative to the support assembly, a second portion movable relative to the first portion, the gathering element being coupled to and movable with the second portion, and a sacrificial member to couple positions of the first and the second portions, and to fail when force applied on the gathering element by the material exceeds a predetermined level.

17 Claims, 4 Drawing Sheets

(56) References Cited

U.S. PATENT DOCUMENTS

| | | | | |
|---|---|---|---|---|
| 2017/0332695 | A1* | 11/2017 | Zappoli | A24D 3/0233 |
| 2020/0107571 | A1* | 4/2020 | Sanna | A24B 3/14 |

FOREIGN PATENT DOCUMENTS

| | | | | |
|---|---|---|---|---|
| EP | 1917871 | A1 * | 5/2008 | A24D 3/0233 |
| EP | 2 085 631 | A1 | 8/2009 | |
| EP | 3456211 | A2 * | 3/2019 | A24D 3/02 |
| JP | 5-219930 | A | 8/1993 | |
| JP | 8-159892 | A | 6/1996 | |
| JP | 2003-139216 | A | 5/2003 | |
| JP | 2007-230734 | A | 9/2007 | |
| JP | 2020-522998 | A | 8/2020 | |
| RU | 2 352 228 | C1 | 4/2009 | |
| RU | 2 410 993 | C2 | 2/2011 | |
| RU | 2 719 247 | C1 | 4/2020 | |
| WO | WO 2016/184928 | A1 | 11/2016 | |
| WO | WO 2018/229087 | A1 | 12/2018 | |

OTHER PUBLICATIONS

Combined Chinese Office Action and Search Report issued Nov. 22, 2025 in Chinese Patent Application No. 202280042817.8 (with English Translation), 12 pages.

International Search Report & Written Opinion mailed on Oct. 7, 2022 in PCT/EP2022/066048 filed on Jun. 13, 2022 (14 pages).

European Search Report dated Dec. 13, 2021 in EP Application 21184922.9 filed on Jul. 9, 2021.

Japanese Office Action issued Mar. 23, 2026 in Japanese Patent Application No. 2024-500327 (submitting unedited computer-generated English Translation only), citing references 2, 3, and 5-8 therein, 2 pages.

* cited by examiner

GATHERING ASSEMBLY

The present disclosure relates to a gathering assembly for use in production of an aerosol generating article. The gathering assembly may be part of a larger system, for example a system for use in production of an aerosol generating article or a rod making machine.

Aerosol generating articles are frequently an assemblage of different kinds of plugs, each of the plugs being made of material formed into a rod shape and wrapped in a wrapping material.

For instance, for heat-not-burn consumables, one of such plugs may comprise a gathered sheet of sensorial media. The sensorial media may be a substrate that generates aerosol when heated, for example a sheet of cast leaf tobacco.

In known systems the material is typically unwound from a bobbin and then passed through a converging funnel. The converging funnel progressively gathers the material into a rod shape.

The converging device is located upstream to an entrance of a rod-forming means. As the gathered material approaches the outlet of the converging funnel, it is deposited on a wrapping material. The wrapping material is pulled or driven by a garniture tape from the outlet of the converging funnel to the rod-forming means via a gathering element.

The gathering element usually has a 'half-funnel' shape. That is, the gathering element comprises a funnel separated into two parts along the machine direction, so that above the sheet of material, there is a half funnel shape, and at the bottom there is the wrapping material.

As the material passes through the gathering element, the material is progressively gathered by the gathering element. That is, the gathering element applies a force on the material. By the exit of the gathering element the material has been formed into a rod of a pre-determined diameter.

The longitudinal edges of the wrapping material are overlapped and glued, forming a continuous cylindrical rod. This continuous rod is then cut into discrete sticks creating the desired components that are used within aerosol generating articles.

At times the band of material passing through the gathering element may have an unexpected increase in thickness or resistance to compression (or both increase in thickness and resistance to compression). The increase in thickness or resistance to compression may only be momentary. For example the increase may occur at the transition between material received from one bobbin and material received from a subsequent bobbin. The increase in thickness or resistance to compression may also occur due to other factors such as the randomness associated with the use of natural materials.

As the material passes through the gathering element, this 'spike' in thickness or resistance to compression may result in the force applied by the material to the gathering element exceeding the material resistance of the gathering element. As a consequence, the gathering element may deform or break under the unexpectedly high force. Removal and replacement of the gathering element can lead to considerable production down-time as the replacement gathering element must be secured and finely adjusted to the correct positioning.

It would be desirable to provide a gathering element and a method of gathering material, which overcomes the above problems.

According to a first aspect there is provided a gathering assembly for use in production of an aerosol generating article, the gathering assembly comprising a gathering element and a support assembly, wherein:

- the gathering element is configured for receiving and gathering a material on the support assembly, the gathering element comprising:
  - an inlet for receiving the material;
  - an outlet for outward passage of the material; and
  - a converging portion, wherein the converging portion is configured to receive the material from the inlet, wherein the converging portion is configured to gather the material on the support assembly as the material passes between the inlet and outlet of the gathering element; and
- the support assembly comprises:
  - a first portion having a fixed position relative to the support assembly;
  - a second portion movable relative to the first portion, wherein the gathering element is coupled to, and movable with, the second portion; and
  - a sacrificial member configured to couple the positions of the first portion and the second portion, wherein the sacrificial member is configured to fail when the force applied on the gathering element by the material exceeds a predetermined level.

The use of a sacrificial member prevents the gathering element becoming damaged in use. If the force applied to the gathering element by the material increases beyond a predetermined level the sacrificial member breaks. Breaking the sacrificial member removes the forces on the gathering element. By ensuring that the gathering element avoids damage, a more reliable system is provided with decreased production down-time. As a result, there is a positive impact in efficiency. In addition, it is only required to replace a simple piece (the sacrificial member), rather than a comparatively expensive component (the entire gathering element). The exchange of the sacrificial member is faster than replacement of the entire gathering element as little fine adjustment is required.

In some embodiments, the material is a web of sheet material.

In some embodiments, the material may include a susceptor. The problems with known systems are of particular concern when producing a rod including an incompressible susceptor.

In some embodiments, the second portion is rotatably coupled to the first portion. The rotational coupling provides a simple but effective way to allow the second portion to move relative to the first portion. Furthermore, by rotatably coupling the first portion and the second portion, only a single fixing point (that is, a single sacrificial element) is required to securely couple or fix the relative positions of the first portion and the second portion.

In some embodiments, the support assembly further comprises a limiter element configured to limit the rotation of the second portion relative to the first portion. The limiter element may prevent collisions between the second portion and other components within the system.

In some embodiments, the second portion is biased away from the support assembly. In some embodiments, the second portion is biased away from the first portion. Biasing the second portion away from the support assembly or away from the first portion ensures that forces on the gathering element are significantly reduced following failure of the sacrificial element. That is, the second portion will actively move away from the support assembly or away from the first portion once the sacrificial element breaks.

In some embodiments, failure of the sacrificial member allows the gathering element to move away from an operational position. In particular, failure of the sacrificial member removes the constraint on the relative positions of the first portion and the second portion. As such, the second portion can move away from the support assembly or away from the first portion and therefore the forces applied to the gathering element by the material are reduced.

In some embodiments, the sacrificial member is configured to fail when the force applied on the outlet of the gathering element by the material exceeds a predetermined level. The diameter of the gathering element is generally smallest at its outlet. The force applied by the band of material on the gathering element is therefore highest at the outlet of the gathering element. As a result, deformation or failure of the gathering element is most likely to occur at the outlet of the gathering element. By linking the failure of the sacrificial member to the force applied on the outlet of the gathering element, the risk of failure of the gathering element is reduced.

In some embodiments, the sacrificial member is configured to fail when the force applied on the outlet of the gathering element by the material exceeds a predetermined level that is less than the vertical failure load at the outlet of the gathering element. The material generally applies a vertical load to the outlet of the gathering element. By considering this vertical load the sacrificial member is configured to fail at a precisely pre-determined load.

In some embodiments, the sacrificial member is configured to fail when the force applied on the outlet of the gathering element by the material exceeds a predetermined level that is the vertical failure load at the outlet of the gathering element divided by a factor of safety, for example 1.5, 2 or more. The factor of safety provides a balance between continued operation and protection of the gathering element.

In some embodiments, the sacrificial member comprises a shear pin.

In some embodiments, the first portion and the second portion each comprise a recess for receiving a portion of the sacrificial member.

In some embodiments, the support assembly further comprises an interface member positioned within the recess of the first portion or the second portion for interfacing between the sacrificial member and the recess.

In some embodiments, the interface member is a bushing or vibration isolator. Interface members, in particular bushings or vibration isolators ensure there is little or no damage to the first portion and the second portion once the sacrificial member breaks.

In some embodiments, the sacrificial member comprises hard steel or tempered steel. Using such hard materials for the sacrificial member ensures that the relative position between the first portion and the second portion is properly maintained during use. That is, the sacrificial member will be subject to little pre-failure deformation so the gathering element will remain stable during use.

In some embodiments, the support assembly further comprises position adjusting means for adjusting the position of the gathering element with respect to the second portion. The position adjusting means allow the gathering element to be aligned with upstream components from which material is passed or downstream components to which material is passed.

According to a second aspect there is provided a system for use in production of an aerosol generating article, the system comprising:

a gathering assembly according to the first aspect; and a support, wherein in use the gathering element of the gathering assembly gathers a material on the support.

In some embodiments, the system further comprises:

a funnel upstream of the gathering assembly; and rod-forming means downstream of the gathering assembly.

According to a third aspect there is disclosed a method of configuring a gathering assembly for use in production of an aerosol generating article, the method comprising:

providing a gathering element and a support assembly, the gathering element for receiving and gathering a material on the support assembly;

wherein the gathering element comprises:

an inlet for receiving the material;

an outlet for outward passage of the material; and a converging portion, wherein the converging portion is configured to receive the material from the inlet, and wherein the converging portion is configured to gather the material on the support assembly as the material passes between the inlet and outlet of the gathering element; and wherein the support assembly comprises:

a first portion having a fixed position relative to the support assembly;

a second portion movable relative to the first portion, wherein the gathering element is coupled to, and movable with, the second portion; and a sacrificial member configured to couple the positions of the first portion and the second portion, wherein the sacrificial member is configured to fail when the force applied on the gathering element by the material exceeds a predetermined level.

In some embodiments, the gathering assembly is that of the gathering assembly first aspect of the invention.

In some embodiments, the method further comprises:

removing the failed sacrificial member from the support assembly when the force applied on the gathering element by the material has exceeded the predetermined level at which the sacrificial member is configured to fail;

The method may further comprise: providing a further sacrificial member configured to couple the positions of the first portion and the second portion, wherein the sacrificial member is configured to fail when the force applied on the gathering element by the material exceeds a predetermined level.

In some embodiments, the sacrificial member and further sacrificial member are both configured to fail when then force applied on the gathering element by the material exceeds the same predetermined level.

In some embodiments, the method further comprises:

determining the failure load at the outlet of the gathering element;

selecting properties for the sacrificial member and a position for the sacrificial member so that the sacrificial member fails before the gathering element fails.

As used herein, the term 'gathering element' is used to describe a channel or channel-like component for gathering a material—that is, forming a material from something substantially two-dimensional, for example a web of sheet material, into something three-dimensional, for example a rod or a rod pre-cursor. Specifically, an interior surface of the gathering element gathers a material as it travels through the gathering element. The material is gathered in directions transverse to the longitudinal direction of the gathering element. As used herein, the term converging portion is used to describe the portion of the gathering element that gathers the material.

As used herein, the term 'fail' is used to describe the failure of a component having reached, or been subject to, a failure load or failure force. Failure may refer to fracture, separation into more than one portion, yield or another threshold.

As used herein, the term 'failure load' or 'failure force' refers to a maximum load or force, respectively, that a component can sustain without failing.

As used herein, the term 'sacrificial member' refers to a component designed to fail at a predetermined limit to protect another component or to allow an additional action or function to occur. In the described examples, the additional action allowed by failure of the sacrificial member is the movement of the second portion relative to the first portion.

As used herein, the term 'predetermined limit' refers to a generally known or considered limit—for example a calculated load.

The invention is defined in the claims. However, below there is provided a non-exhaustive list of non-limiting examples. Any one or more of the features of these examples may be combined with any one or more features of another example, embodiment, or aspect described herein.

Ex 1. A gathering assembly for use in production of an aerosol generating article, the gathering assembly comprising:

a gathering element for receiving and gathering a material on a support, the gathering element comprising:
- an inlet for receiving the material;
- an outlet for outward passage of the material; and
- a converging portion, wherein the converging portion is configured to receive the material from the inlet, wherein the converging portion is configured to gather the material on the support as the material passes between the inlet and outlet of the gathering element; and a support assembly, the support assembly comprising:
- a first portion having a fixed position relative to the support;
- a second portion movable relative to the first portion, wherein the gathering element is coupled to, and movable with, the second portion; and
- a sacrificial member configured to couple the positions of the first portion and the second portion, wherein the sacrificial member is configured to fail when the force applied on the gathering element by the material exceeds a predetermined level.

Ex 2. A gathering assembly according to Ex 1, wherein the material is a web of sheet material.

Ex 3. A gathering assembly according to Ex 1, wherein the second portion is rotatably coupled to the first portion.

Ex 4. A gathering assembly according to Ex 3, wherein the support assembly further comprises a limiter element configured to limit the rotation of the second portion relative to the first portion.

Ex 5. A gathering assembly according to any preceding example, wherein the second portion is biased away from the support.

Ex 6. A gathering assembly according to any preceding example, wherein failure of the sacrificial member allows the gathering element to move away from an operational position.

Ex 7. A gathering assembly according to any preceding example, wherein the sacrificial member is configured to fail when the force applied on the outlet of the gathering element by the material exceeds a predetermined level.

Ex 8. A gathering assembly according to Ex 7, wherein the sacrificial member is configured to fail when the force applied on the outlet of the gathering element by the material exceeds a the predetermined level that is less than the vertical failure load at the outlet of the gathering element.

Ex 9. A gathering assembly according to Ex 8, wherein the sacrificial member is configured to fail when the force applied on the outlet of the gathering element by the material exceeds a predetermined level that is the vertical failure load at the outlet of the gathering element divided by a factor of safety, for example 1.5, 2 or more.

Ex 10. A gathering assembly according to any preceding example, wherein the sacrificial member comprises a shear pin.

Ex 11. A gathering assembly according to any preceding example, wherein the first portion and the second portion each comprise a recess for receiving a portion of the sacrificial member.

Ex 12. A gathering assembly according to Ex 11, wherein the support assembly further comprises an interface member positioned within the recess of the first portion or the second portion for interfacing between the sacrificial member and the recess.

Ex 13. A gathering assembly according to Ex 12, wherein the interface member is a bushing or vibration isolator.

Ex 14. A gathering assembly according to any preceding example, wherein the sacrificial member comprises hard steel or tempered steel.

Ex 15. A gathering assembly according to any preceding example, wherein the support assembly further comprises position adjusting means for adjusting the position of the gathering element with respect to the second portion.

Ex 16. A system for use in production of an aerosol generating article, the system comprising:
- a gathering assembly according to any preceding example; and
- a support, wherein in use the gathering element of the gathering assembly gathers a material on the support.

Ex 17. A system according to Ex 16, further comprising:
- a funnel upstream of the gathering assembly; and
- rod-forming means downstream of the gathering assembly.

Ex 18. A method of configuring a gathering assembly for use in production of an aerosol generating article, the method comprising:

providing a gathering element for receiving and gathering a material on a support, the gathering element comprising:
- an inlet for receiving the material;
- an outlet for outward passage of the material; and
- a converging portion, wherein the converging portion is configured to receive the material from the inlet, and wherein the converging portion is configured to gather the material on the support as the material passes between the inlet and outlet of the gathering element;

providing a support assembly, the support assembly comprising:
- a first portion having a fixed position relative to the support;
- a second portion movable relative to the first portion, wherein the gathering element is coupled to, and movable with, the second portion; and
- a sacrificial member configured to couple the positions of the first portion and the second portion, wherein the sacrificial member is configured to fail when the force applied on the gathering element by the material exceeds a predetermined level.

Ex 19. A method according to Ex 18, wherein the method further comprises:

removing the failed sacrificial member from the support assembly when the force applied on the gathering element by the material has exceeded the predetermined level at which the sacrificial member is configured to fail.

Ex. 20 A method according to Ex. 19, wherein the method further comprises providing a further sacrificial member configured to couple the positions of the first portion and the second portion, wherein the sacrificial member is configured to fail when the force applied on the gathering element by the material exceeds a predetermined level.

Ex 21. A method according to Ex 20, wherein the sacrificial member and further sacrificial member are both configured to fail when then force applied on the gathering element by the material exceeds the same predetermined level.

Ex 22. A method according to Ex 18, the method further comprising:

determining the failure load at the outlet of the gathering element;

selecting properties for the sacrificial member and a position for the sacrificial member so that the sacrificial member fails before the gathering element fails.

Examples will now be further described with reference to the figures in which.

Figure 1:
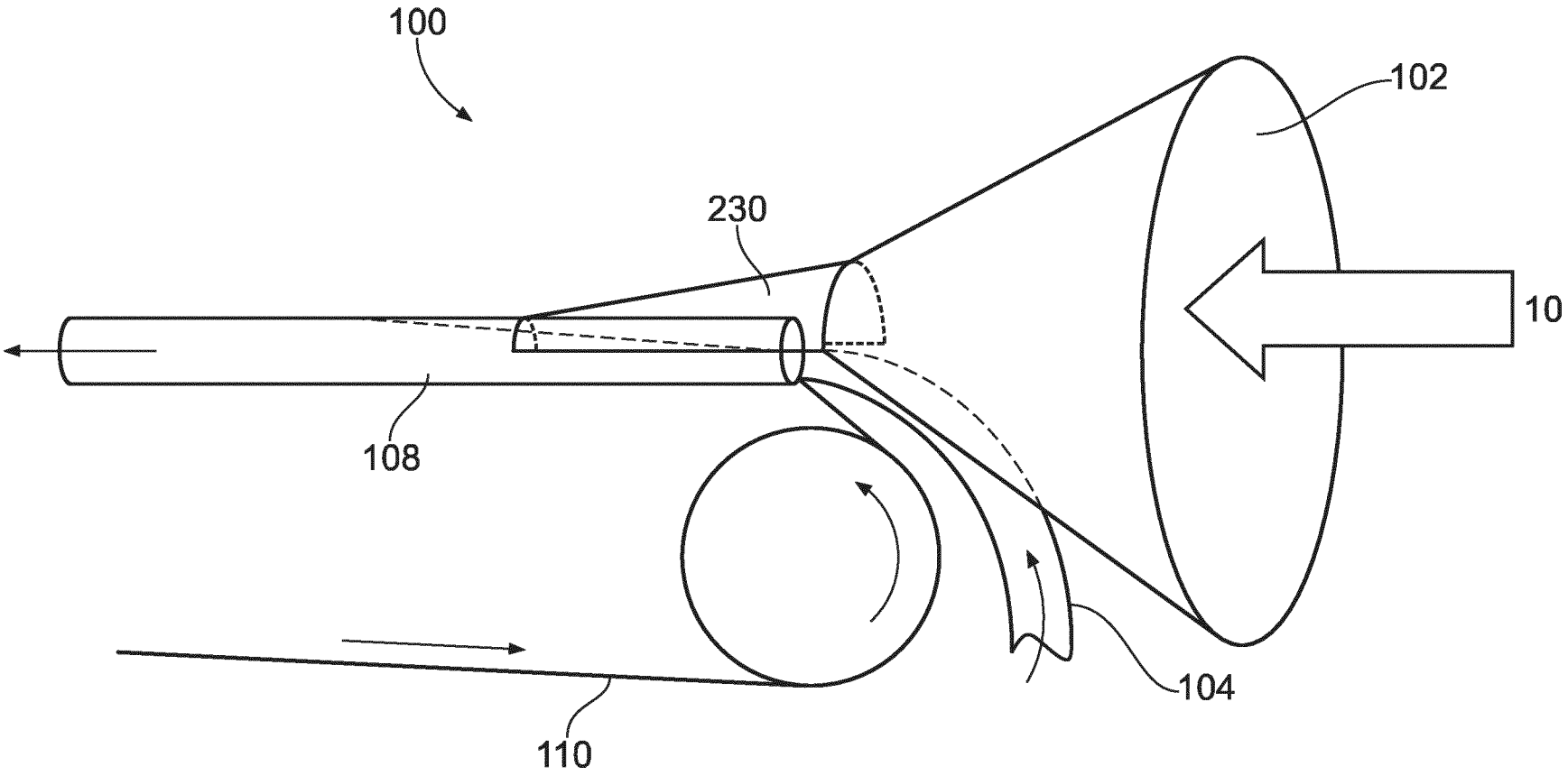
FIG. 1 illustrates a schematic perspective view of a typical system used in the production of rod components for aerosol generating articles.

FIG. 1 illustrates a system 100 for use in production of an aerosol generating article. The system 100 includes a converging funnel 102 for receiving material to be formed into a rod or plug. In use, the material is received in the direction of arrow 10. The converging funnel 102 progressively gathers the material into a rod shape.

In general, the material is provided as a web of sheet material (not shown), for example a tobacco compound such as cast leaf tobacco. The web of sheet material may have a width of 5 cm to 25 cm. The web of sheet material may have been subject to various pre-treatments including for instance crimping.

As the gathered material approaches the outlet of the converging funnel 102, it is located on a wrapping material 104. The wrapping material 104 is pulled or driven by a support from the outlet of the converging funnel 102 to the downstream components (described below). In this example the support is a garniture tape 110 but in other examples the support may be a garniture tongue.

The system 100 further includes a gathering element 230 for receiving and gathering the material on the support. The gathering element 230 is positioned downstream of the converging funnel 102. The gathering element 230 receives the material from the converging funnel 102 and then further gathers the material into a rod of pre-determined diameter.

The material may be gathered around a metal strip like, for example, a susceptor, a material capable of converting electromagnetic energy into heat, sufficient to create an aerosol from an aerosol-forming substrate. The susceptor is present within the final rod.

The system 100 further includes a rod-forming means 108 downstream of the gathering element 230. As the material passes through the rod-forming means 108 the longitudinal edges of the wrapping material 104 are overlapped and glued, forming a continuous cylindrical rod. The rod-forming means 108 has a opening on top allowing to achieve the closing and gluing of the wrapping material 104 around the moving compressed band of material. The continuous rod is then cut into discrete sticks creating the desired components that are used within aerosol generating articles.

The gathering element 230 is part of a gathering assembly 220. For clarity only the gathering element 230 of the gathering assembly 220 is shown in FIG. 1. The gathering assembly 220 is shown in FIGS. 2 to 8.

The gathering element 230 includes an inlet 232 for receiving the material. The gathering element 230 further includes an outlet 234 for outward passage of the material. The gathering element 230 further includes a converging portion 236 configured to receive the material from the inlet 232, and gather the material on the support as it passes between the inlet 232 and outlet 234 of the gathering element 230. The direction of travel of the material, as driven by the garniture tape 238, is indicated by arrow 238 in FIG. 2.

The converging portion 236 of the gathering element 230 has a generally 'half-funnel' shape. That is, the shape of the converging portion 236 of the gathering element 230 corresponds to a funnel separated into two parts along the machine direction.

The gathering assembly 220 further includes a support assembly 240. In general, the support assembly 240 provides a support to which the gathering element 230 is mounted or coupled.

The support assembly 240 includes a first portion 242 having a fixed position relative to the support. In this example, where the support is garniture tape 110, the first portion 242 has a fixed position relative to the static position of the garniture tape 110. That is, the first portion 242 is static within the system.

The support assembly 240 further includes a second portion 244. The second portion 244 is movable relative to the first portion 242. In this example, the second portion 244 is movable relative to the first portion 242 by rotation. That is, the second portion 244 is rotatably coupled to the first portion 242.

Figure 7:
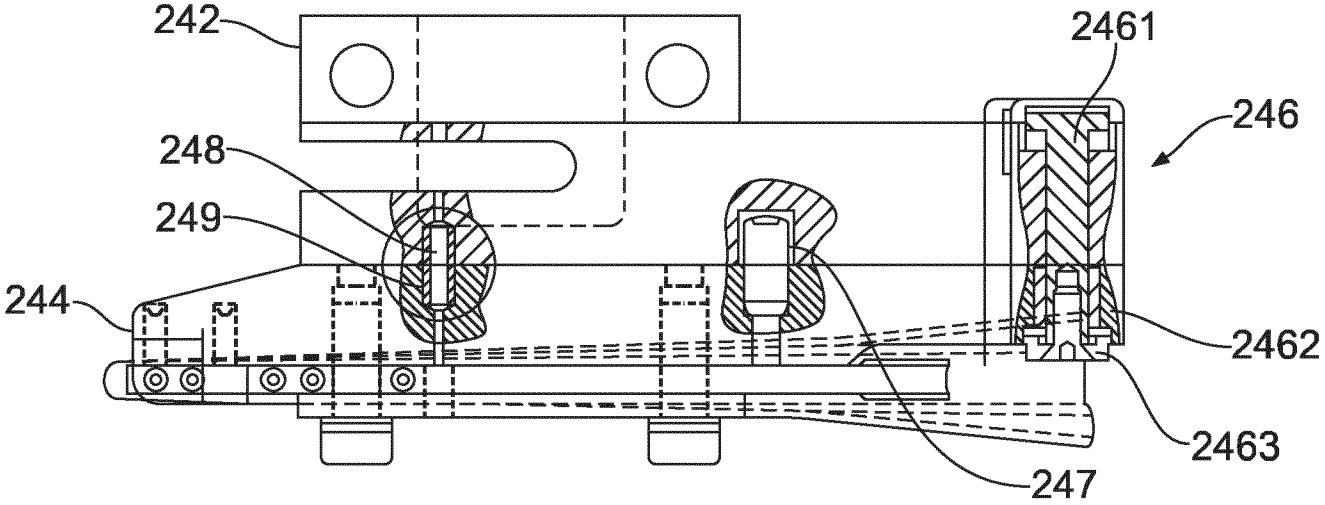
FIG. 7 illustrates a top cross-sectional view of the gathering assembly of FIG. 2.

In this example, the first portion 242 and second portion 244 are rotatably coupled by a shaft assembly 246. As shown in FIG. 7, in this example, the shaft assembly 246 includes a shaft 2461 that extends through the first portion 242 and into the second portion 244. The first portion 242 is fixed relative to, or attached to, the shaft 2461. The second portion 244 is free to rotate about the shaft 2461 as an axis of rotation. In this example, the shaft assembly 246 includes a housing 2462 mounted within the second portion 244. The second portion 244 is fixed relative to the housing 2462 via a fixing element 2463. In this example the fixing element 2463 extends into a hollow end of the shaft 2461 and is freely rotatable within the shaft 2461. The shaft 2461 is received within the housing 2462 such that the shaft 2461 can freely rotate within the housing 2462. In some examples additional bearings or lubricants may be included between the housing 2462 and shaft 2461 to reduce friction.

In other examples other suitable rotatable couplings may be used to rotatably couple the first portion 242 and second portion 244. For example, the shaft assembly 246 may include a single shaft that passes through both the first portion 242 and the second portion 244. The first portion 242 may be attached to the shaft, while the second portion 244 is free to rotate about the shaft as axis of rotation. That is, the shaft is freely received within a recess in the second portion 244.

The gathering element 230 is coupled to, and movable with, the second portion 244. That is, rotation of the second portion 244 relative to the first portion 242 also rotates the gathering element 230 relative to the first portion 242.

In this example, the gathering element 230 is oriented perpendicular to the axis of rotation of the second portion 244. That is, the gathering element 230 is oriented perpendicular to the shaft assembly 246. The distance between the outlet 234 of the gathering element 230 and the shaft assembly 246 is greater than the distance between the inlet 232 of the gathering element 230 and the shaft assembly 246. In this manner, as the second portion 244 rotates relative to the first portion 242 the outlet 234 of the gathering element 230 moves away from the support compared to the inlet 232 of the gathering element 230.

The support assembly 240 further includes a sacrificial member 248 configured to couple the positions of the first portion 242 and second portion 244. In this example, the sacrificial member 248 prevents relative rotation between the first portion 242 and the second portion 244. That is, the sacrificial member 248 substantially fixes the position of the second portion 244 relative to the first portion 242.

In this example, the sacrificial member 248 comprises an elongate pin. The first portion 242 and second portion 244 each comprise a recess for receiving a portion of the sacrificial member 248. In general, as shown in FIG. 7, the recesses extend inwardly from corresponding faces of the first portion 242 and second portion 244 in a direction that is parallel to the axis of rotation. The recesses are located on a side face of each of the first portion 242 and the second portion 244. In use, the side face of the first portion 242 having a recess faces the side face of the second portion 244 having a recess. As such, when the recesses are aligned the sacrificial member 248 can extend into both the first portion 242 and the second portion 244 simultaneously. The sacrificial member 248 can therefore prevent relative rotation between the first portion and the second portion 244.

Figures 2, 3:
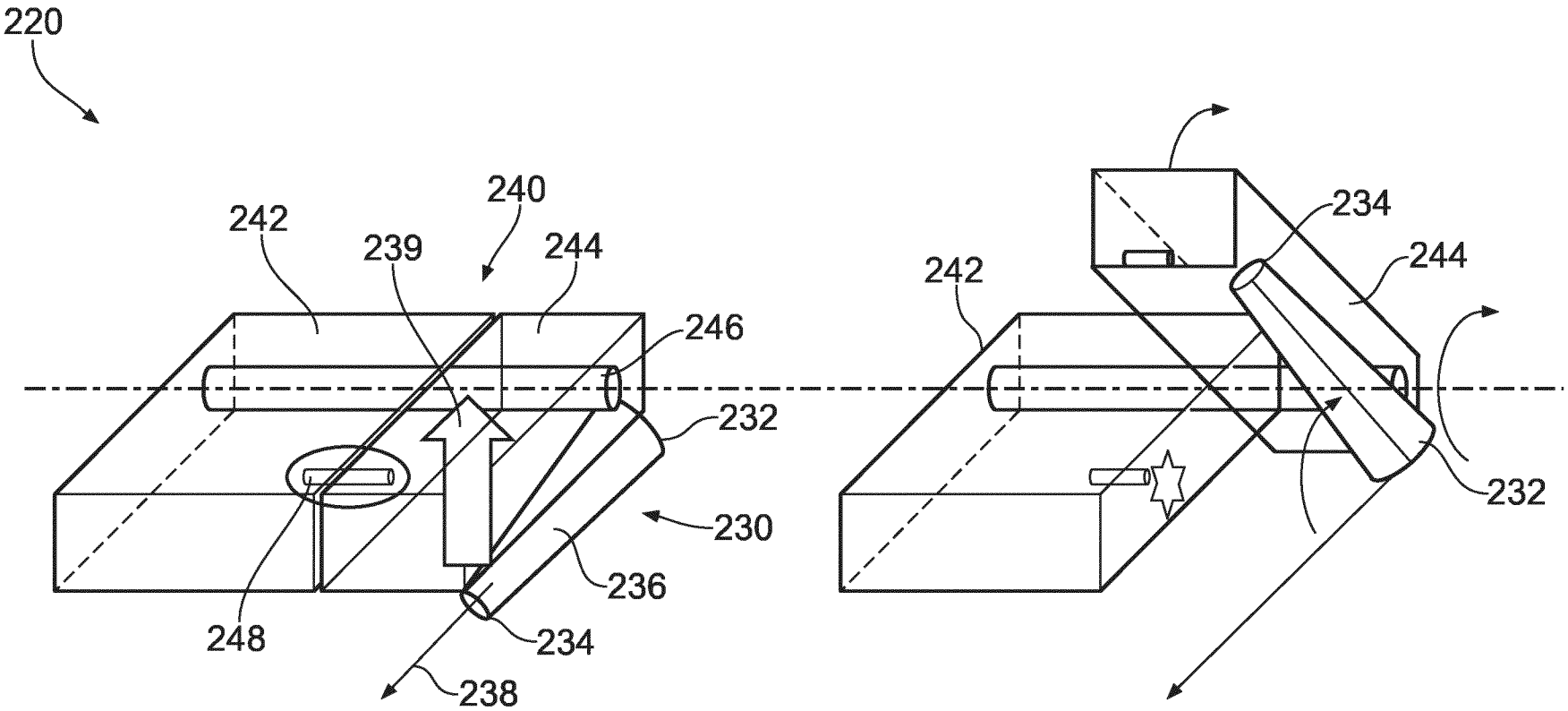
FIG. 2 illustrates a schematic perspective view of a gathering assembly in an operational configuration.
FIG. 3 illustrates a schematic perspective view of the gathering assembly of FIG. 2 in a non-operational configuration.
Figure 4:
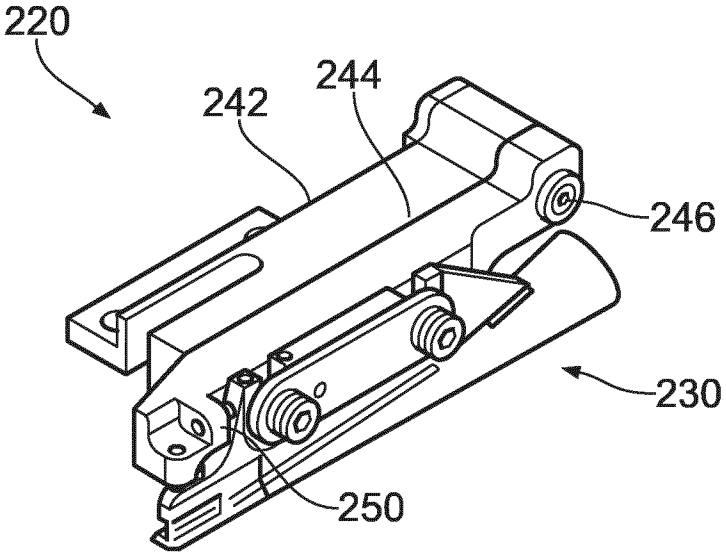
FIG. 4 illustrates a perspective view of the gathering assembly of FIG. 2 in an operational configuration.

FIG. 2 and FIG. 4 illustrate the gathering assembly 220 in an operational configuration. The first portion 242 and second portion 244 are positioned with corresponding recesses aligned. The sacrificial member 248 extends into the recesses of both the first portion 242 and the second portion 244. The position of the second portion 244 and the gathering element 230 is therefore fixed with respect to the first portion 242. As such, the gathering assembly 220 can be positioned so that the gathering element 230 is located in its operational position adjacent to and parallel to the support.

The support assembly 240 may include position adjusting means 250 for adjusting the position of the gathering element 230 with respect to the second portion 244. In this way, the operational position of the gathering element 230 can be adjusted to ensure that the gathering element 230 is aligned with upstream components and downstream components, like, for example rod-forming means and funnel devices.

Figure 5:
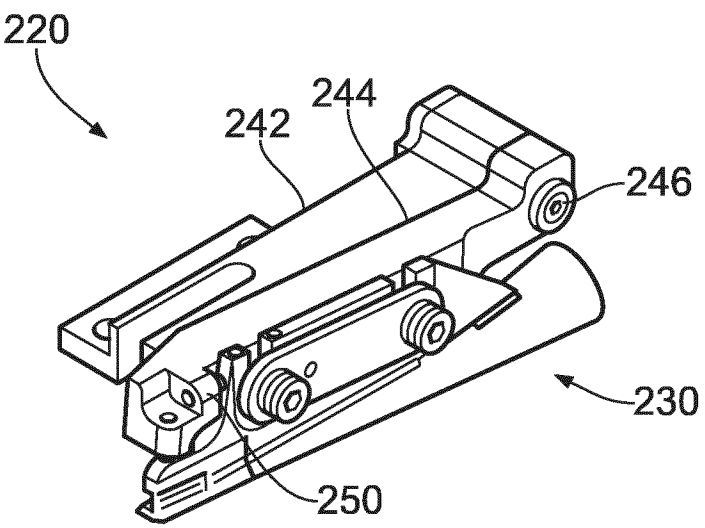
FIG. 5 illustrates a perspective view of the gathering assembly of FIG. 2 in a non-operational configuration.
Figure 6:
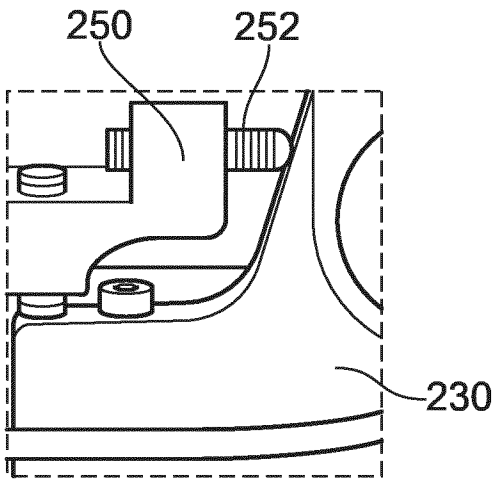
FIG. 6 illustrates adjustment means for a gathering assembly.

As shown in FIGS. 4 to 6, in this example the position adjusting means 250 includes at least one screw 252 mounted on the second portion 244. In use, advancement of the screw 252 presses on the gathering element 230 to adjust its position relative to the second portion 244. There may be multiple screws to adjust the position of the gathering element 230 in multiple dimensions relative to the second portion 244.

In use, as the material passes through the gathering element 230, the material is increasingly gathered on the underlying support by the converging portion 236 as the cross-sectional dimensions of the converging portion 236 decrease. As the material is gathered on the support, a reaction force is applied by the material to the gathering element 230. This generally vertical force increases as the material approaches the outlet 234 of the gathering element 230 and is typically at its maximum at the outlet 234.

The sacrificial member 248 is configured to fail when the force applied on the gathering element 230 by the material exceeds a predetermined level. That is, the sacrificial member 248 is configured so as to have a failure load that corresponds to the force on the gathering element 236 exceeding a predetermined level.

In this example, the sacrificial member 248 is configured to fail when the force applied on the outlet 248 of the gathering element 230 by the material exceeds a predetermined level. The predetermined level is less than the vertical failure load at the outlet 234 of the gathering element 230. That is, the sacrificial member 248 is configured to fail before the vertical load applied by the material to the outlet 234 of the gathering element 230 reaches a failure limit, like, for example the maximum tolerated vertical force at the outlet 234.

With the arrangement described above, the upward force from the material onto the gathering element 230 generates a moment urging the gathering element 230 to rotate. The moment results in a shear load 239 on the sacrificial member 248. In this example, the sacrificial member 248 is a shear pin configured to fail when the shear load reaches a predetermined shear load.

Figure 8:
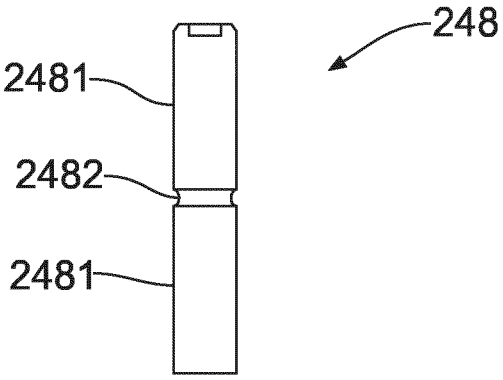
FIG. 8 illustrates a sacrificial member for a gathering assembly.

FIG. 8 illustrates an example shear pin (shown in FIG. 7). The shear pin 248 includes outer portions 2481 and a central portion or notch 2482, located between the outer portions 2481. The notch 2482 has a smaller diameter than the outer portions 2481 and will generally be the point of failure in the shear pin. In use, as shown in FIG. 7, the shear pin 248 can be positioned within the recesses of the first portion 242 and the second portion 244 so that the notch 2482 is positioned at the interface between the first portion 242 and the second portion 244. Positioning the notch at the interface between the first portion 242 and the second portion 244 ensures that the break in the shear pin will allow relative movement between the first portion 242 and the second portion 244.

FIG. 3 illustrates the gathering assembly 220 in a non-operational configuration. Specifically, the sacrificial member 248 has failed allowing rotation of the second portion 244 relative to the first portion 242 (as indicated by the arrows). In the same way, the gathering element 230 has been allowed to move away from its operational position. This removes, or at least significantly reduces, the force applied by the material on the gathering element 230. A method of selection of a suitable sacrificial member 248 for the support assembly 240 may include the following steps:

Determining the failure load at the outlet 234 of the gathering element 230;

Selecting suitable properties for the sacrificial member 248 and a suitable position for the sacrificial member 248 so that the sacrificial member 248 fails before the gathering element 230 fails.

For example, the failure load at the outlet 234 and the distance of the outlet 234 from the axis of rotation can be used to determine a failure torque or moment for the gathering element 230. The torque applied to the sacrificial member 248 by the material is substantially equal to the torque applied to the outlet 234 of the gathering element 230 by the material. As such, the position, materials and dimensions of the sacrificial member 248 can be selected so that the failure torque or moment of the sacrificial member 248 is less than that of the gathering element 230.

A factor of safety may be included at any stage of the above example calculations. That is, the predetermined level of force applied to the gathering element 230 by the material at which the sacrificial member 248 is configured to fail may be the failure load of the gathering element 230 divided by a factor of safety, for example 1.5.

In this example the sacrificial member 248 comprises hard steel or tempered steel. Using a hard material not prone to deformation allows the relative position between the first portion 242 and the second portion 244 to be maintained. This keeps the gathering element 230 in the correct position to gather the material into the correct diameter.

A non-limiting example calculation may be as follows:

Lt=distance between the outlet 234 of the gathering element 230 and the axis of rotation Ft=vertical force applied to the outlet 234 of the gathering element 230 by the material Ls=distance between the sacrificial member 248 and the axis of rotation Fs=vertical force applied to the sacrificial member 248 via gathering element 230 and second portion 244

Equating the torque at the sacrificial member 248 to the torque at the outlet 234 of the gathering element:

$$Ft \times Lt = Fs \times Ls$$

The failure load at the outlet 234 of the gathering element 230 may be calculated theoretically, for example from the shape and material of the gathering element 230. The failure load at the outlet 234 of the gathering element 230 may be determined with known experimental methods (or both).

For a maximum vertical force supported by the outlet 234 of 4000N, Ft=4000N.

If including a factor of safety of 2, Ft may be reduced to 2000N. That is, gathering element 230 should only experience at most 2000N in use.

$$Fs = 2000 \times Lt/Ls \quad (1)$$

Also, for the sacrificial member:

Shear stress=Fs/surface of the section

Fs=Shear stress×surface of the section

Fs=Shear stress×Pi×(radius)$^2$

If using D3 hardened steel, the ultimate shear strength ~1220 MPa, which is about 60 percent of its ultimate tensile strength. For a D3 hardened steel shear pin to break the shear stress must equal its ultimate shear strength. Therefore:

$$Fs = 1220 \text{ MPa} \times Pi \times (\text{radius})^2 \quad (2)$$

If, as examples, Lt=195 mm and Ls=125 mm, by equating equations (1) and (2) above it can be calculated that the notch radius of the sacrificial member 248 should be 9 mm.

In this example an interface member 249 is positioned within the recess of the first portion 242 or the second portion 244 (as shown in FIG. 7). The interface member 249 provides an interface between the sacrificial member 248 and the recess. For example, the interface member 249 may be a bushing or vibration isolator. By providing an interface member 249 to interface between the sacrificial member 248 and either or both of the first portion 242 and the second portion 244, the first portion 242 and the second portion 244 may be protected from the sacrificial member 248 as it breaks. That is, the bushing or vibration isolator may absorb or dampen the mechanical energy of the breaking sacrificial member 248. This allows for repetitive renewal of the sacrificial member 248, without damage to the main body of the support assembly 240.

The support assembly 240 may further include a limiter element configured to limit the rotation of the second portion 244 relative to the first portion 242. For example, the limiter element may prevent excessive rotation of the second portion 244 that risks the second portion 244 colliding with parts of the system, for example the converging funnel 102.

Any suitable limiter element may be used. In this example (as shown in FIG. 7), the limiter element is a protrusion 247 that protrudes from the second portion 244. The protrusion 247 extends into a corresponding recess in the first portion 242. The boundaries of the recess delimit the extent of movement of the second portion 244. For example, the recess may be arranged in an arc having a radius centred on the axis of rotation, thereby allowing the second portion 244 to rotate with respect to first portion 242 until the protrusion 247 is blocked by the end of the groove. As such, the limiter defines the maximum rotation angle of the second portion 244.

In some examples the gathering assembly 220 may be biased towards its non-operational configuration. In particular the second portion 244 may be biased away from the support. In this manner, as the sacrificial member 248 breaks the second portion 248 and gathering element 230 moves away from the support to ensure that the forces applied by the material to the gathering element 230 are removed. Any suitable biasing means may be used. For example, the second portion 244 may be spring-mounted to the first portion 242.

Various modifications to the detailed arrangements as described above are possible. For example, the first portion 242 and the second portion 244 may not be rotatably coupled. Instead the second portion 244 may translate relative to the first portion 242 as the gathering assembly 220 moves to its non-operational configuration. That is, the entire gathering element 230 may move away from the support upon failure of the sacrificial member 248.

It will also be appreciated by those skilled in the art that any number of combinations of the aforementioned features and those shown in the appended drawings provide clear advantages over the prior art and are therefore within the scope of the invention described herein.

The schematic drawings are not necessarily to scale and are presented for purposes of illustration and not limitation. The drawings depict one or more aspects described in this disclosure. However, it will be understood that other aspects not depicted in the drawings fall within the scope of this disclosure.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±25 percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A gathering assembly for production of an aerosol generating article, the gathering assembly comprising:
- a gathering element; and
- a support assembly,
- wherein the gathering element is configured to receive and to gather a material on the support assembly,
- wherein the gathering element comprises
  - an inlet configured to receive the material,
  - an outlet configured for outward passage of the material, and
  - a converging portion configured to receive the material from the inlet and to gather the material on the support assembly as the material passes between the inlet and the outlet of the gathering element, and
- wherein the support assembly comprises
  - a first portion having a fixed position relative to the support assembly,
  - a second portion movable relative to the first portion, wherein the gathering element is coupled to, and movable with, the second portion, and
  - a sacrificial member configured to couple the positions of the first portion and the second portion, and to fail when a force applied on the gathering element by the material exceeds a predetermined level.

2. The gathering assembly according to claim 1, wherein the material is a web of sheet material.

3. The gathering assembly according to claim 1, wherein the second portion is rotatably coupled to the first portion.

4. The gathering assembly according to claim 3, wherein the support assembly further comprises a limiter element configured to limit a rotation of the second portion relative to the first portion.

5. The gathering assembly according to claim 1, wherein the second portion is biased away from the support assembly.

6. The gathering assembly according to claim 1, wherein failure of the sacrificial member allows the gathering element to move away from an operational position.

7. The gathering assembly according to claim 1, wherein the sacrificial member is configured to fail when the force applied on the outlet of the gathering element by the material exceeds the predetermined level.

8. The gathering assembly according to claim 7, wherein the sacrificial member is further configured to fail when the force applied on the outlet of the gathering element by the material exceeds a predetermined level that is less than a vertical failure load at the outlet of the gathering element.

9. The gathering assembly according to claim 1, wherein the sacrificial member comprises a shear pin.

10. The gathering assembly according to claim 1, wherein the first portion and the second portion each comprise a recess configured to receive a portion of the sacrificial member.

11. The gathering assembly according to claim 10, wherein the support assembly further comprises an interface member positioned within the recess of the first portion or the second portion being configured to interface between the sacrificial member and the recess.

12. The gathering assembly according to claim 11, wherein the interface member is a bushing or a vibration isolator.

13. The gathering assembly according to claim 1, wherein the sacrificial member comprises hard steel or tempered steel.

14. The gathering assembly according to claim 1, wherein the support assembly further comprises position adjusting means for adjusting a position of the gathering element with respect to the second portion.

15. A system for production of an aerosol generating article, the system comprising:
- a gathering assembly according to claim 1; and
- a support,
- wherein the gathering element of the gathering assembly is configured to gather the material on the support.

16. The system according to claim 15, further comprising:
- a funnel upstream of the gathering assembly; and
- rod-forming means downstream of the gathering assembly.

17. A method of configuring a gathering assembly for production of an aerosol generating article, the method comprising:
- providing a gathering element and a support assembly, the gathering element being configured to receive and to gather a material on the support assembly,
- wherein the gathering element comprises
  - an inlet configured to receive the material,
  - an outlet configured for outward passage of the material, and
  - a converging portion configured to receive the material from the inlet and to gather the material on the support assembly as the material passes between the inlet and the outlet of the gathering element, and
- wherein the support assembly comprises:
  - a first portion having a fixed position relative to the support assembly,
  - a second portion movable relative to the first portion, wherein the gathering element is coupled to, and movable with, the second portion, and
  - a sacrificial member configured to couple the positions of the first portion and the second portion, and to fail when a force applied on the gathering element by the material exceeds a predetermined level.

* * * * *